US006520728B1

(12) United States Patent
Schwitters

(10) Patent No.: US 6,520,728 B1
(45) Date of Patent: Feb. 18, 2003

(54) SYSTEM AND METHOD FOR ELEVATING A WATERCRAFT

(76) Inventor: Wayne Schwitters, 7060-120th Ave. SE., Clara City, MN (US) 56222

( * ) Notice: Subject to any disclaimer, the term of this patent is extended or adjusted under 35 U.S.C. 154(b) by 0 days.

(21) Appl. No.: 09/669,119

(22) Filed: Sep. 25, 2000

(51) Int. Cl.[7] ..... B63C 1/06

(52) U.S. Cl. ..... 414/467; 414/678; 414/481; 414/917; 405/3; 405/7; 114/44

(58) Field of Search ..... 414/481, 482, 414/483, 484, 467, 473, 474, 476, 917, 678; 405/3, 7; 114/44, 50

(56) References Cited

U.S. PATENT DOCUMENTS

| | | | | |
|---|---|---|---|---|
| 2,809,496 A | | 10/1957 | Geil | |
| 2,887,238 A | * | 5/1959 | Huber | 414/483 |
| 3,140,003 A | | 7/1964 | Horner | |
| 3,221,899 A | * | 12/1965 | Gronlund | 414/483 |
| 3,227,292 A | * | 1/1966 | Jacobs | 414/483 |
| 3,656,639 A | | 4/1972 | Lothen | |
| 3,826,391 A | | 7/1974 | Prince | |
| 3,831,790 A | | 8/1974 | Farris | |
| 3,856,168 A | | 12/1974 | Mauck | |
| 3,895,592 A | * | 7/1975 | King | 114/45 |
| 4,365,923 A | | 12/1982 | Lubbers | |
| 4,684,145 A | | 8/1987 | Tingley | |
| 5,013,206 A | | 5/1991 | Ernst et al. | |
| 5,240,347 A | * | 8/1993 | Williams et al. | 405/3 |
| 5,332,249 A | | 7/1994 | Solberg et al. | |
| 5,540,540 A | * | 7/1996 | Peterson | 414/563 |
| 6,059,263 A | * | 5/2000 | Otem et al. | 254/89 H |
| 6,092,961 A | * | 7/2000 | Kilgore | 405/7 |
| 6,139,219 A | * | 11/2000 | Vinarsky | 405/7 |

FOREIGN PATENT DOCUMENTS

| | | |
|---|---|---|
| DE | 431726 | 12/1994 |

* cited by examiner

*Primary Examiner*—Joseph A. Fischetti
(74) *Attorney, Agent, or Firm*—Alan D. Kamrath; Rider, Bennett, Egan & Arundel

(57) ABSTRACT

An apparatus (10) is provided for elevating a watercraft out of a body of water and maintaining the watercraft at a predetermined elevation over the water or removing the watercraft therefrom for towage behind a vehicle. Apparatus (10) includes a forwardly elevated ramp (12) onto which the watercraft may propel itself. Also included is displaceable catch arms (36) which pivot between an engaged position and a released position. Each catch arm (36) is biased toward the engaged position and is constructed and arranged such that it is displaced to the released position when the watercraft is propelling itself up ramp (12). After the watercraft has passed an engagement member (44) attached at the distal end (40) of catch arm (36), catch arm (36) is urged toward the engaged position and engagement member (44) makes contact with the stem of the watercraft and prevents rearward motion thereby. A release mechanism (18) is operably attached to catch arm (36) and is usable from a position inside the watercraft to return catch arm (36) to the released position, thereby releasing the watercraft.

20 Claims, 3 Drawing Sheets

4
4

SYSTEM AND METHOD FOR ELEVATING A WATERCRAFT

BACKGROUND OF THE INVENTION

The present invention pertains generally to a watercraft lift or trailer.

Watercraft lifts are used to elevate a watercraft above the surface of a body of water for temporary or long-term storage when the watercraft is not being used. Watercraft trailers are often similar to watercraft lifts except that they can be attached to the trailer hitch of an automobile or truck and used to remove a watercraft from a body of water and to transport the craft to a different location over land.

Elevating a watercraft above the water is advantageous over mooring the watercraft to a dock or pier for several reasons. When a watercraft hull remains in a relatively still body of water over an extended period, aquatic organisms attach themselves to the hull, adversely affecting the hydrodynamics of the craft, and potentially fouling intakes, sensors, control surfaces, anchoring mechanisms, rudders and the like. These aquatic organisms, including various algae and barnacles, can be extremely difficult and expensive to remove.

Storing a watercraft on a lift is also advantageous in that it prevents the craft from being damaged as a result of moving back and forth against a dock or pier by wind or wave action. Elevating the craft also prevents extreme weather from causing the craft to become released from a dock. Removing a watercraft from a body of water using a trailer provides the same advantages. Trailers can also be used to store watercraft when not transporting them.

Known watercraft lifts typically include a frame supported by four adjustable legs for placement on the bottom of a lake or ocean, a cover, and a carriage assembly. The carriage assembly usually has a plurality of contact pads or skids which are constructed and arranged to support the hull of a given watercraft. A lifting mechanism attached to the frame of the lift allows the carriage assembly to be raised and lowered. This mechanism usually includes a winch and pulley system which is either manually operated or powered by a motor.

In operation, a watercraft is placed on such a watercraft lift by first lowering the carriage assembly below the surface of the water using the winch. Quite often, the unladen carriage assembly is too buoyant to easily lower below the surface of the water. This is especially true when the contact pads are made of wood or other buoyant material, or when the carriage assembly is made of a lightweight, hollow material such as tubular aluminum. Weights are often tied to the bottom of the carriage assembly to overcome this problem.

Once the carriage assembly is sufficiently submerged, the watercraft is carefully driven to a position above the carriage assembly. Care must be taken to avoid colliding the watercraft into the stationary upright members of the lift which support the carriage assembly and the cover. It is also important to prevent the watercraft from being positioned too far forward or rearward of the carriage assembly. It is usually necessary to obtain assistance from another person to properly position the watercraft over the carriage assembly and maintain that position until the carriage assembly can be raised enough to prevent the watercraft from moving. If the waters are rough, it can be very difficult to keep the watercraft in position and prevent the watercraft from being slammed against the stationary uprights while the carriage assembly is being raised, even with the aid of additional people.

Next, the carriage assembly is raised while the watercraft position is maintained above the carriage assembly. A manual winch is usually used to accomplish raising the assembly. The carriage assembly is raised until the watercraft is completely elevated above the surface of the water. Usually, it is desired to elevate the watercraft so that the propeller, as well as the hull, is above the water's surface. This is a laborious process which often takes several minutes and countless revolutions of a winch wheel.

A motor operated winch necessarily requires a motive force. This is usually electric current, either direct current from a battery or alternating current from a shore source. There are obvious hazards associated with the use of electric current near the water. Though direct current is not as dangerous as alternating current, marine batteries are expensive and, unless used in conjunction with a recharging apparatus, such as an internal.combustion engine equipped with an alternator-generator, short lived. The use of an internal combustion engine to assist in operating the winch is inefficient and impractical.

Lowering the craft also presents problems. The winch wheel is turned to lower the craft toward the water. This cannot be performed from inside the watercraft. Therefore, it is necessary to leave the craft unmanned, or to solicit the aid of an additional person to operate the winch.

Once the winch wheel is turned, gravity assists in the lowering of the watercraft, making the winch wheel spin accordingly. It is possible for the winch wheel to gain momentum and achieve dangerous speeds. Often, a knob protrudes outwardly from the wheel to assist in raising the lift. If attached, this knob can create a hazard when the wheel is spinning while the watercraft is being lowered.

Once the carriage assembly is lowered and the watercraft is floating in the water, the watercraft must be held in place while the winch operator boards the watercraft. This can be hazardous, especially in inclement weather. Additionally, rough waters can present the same hazards that exist when raising the watercraft, namely, the watercraft can collide with the stationary upright supports while the watercraft operator takes the helm and gets the watercraft motor started. Care must also be taken when backing the watercraft out of the lift once the watercraft is started and underway.

Known trailers provide similar hazards. Typically, the trailer is backed into the body of water down a ramp or watercraft landing. Once the trailer is in place and partially submerged, the watercraft must be sailed or driven to a position over the trailer. Usually, at least one other person, not aboard the watercraft, is needed to maintain the watercraft in a proper position over the trailer while the watercraft is attached to the trailer and winched forward to a final position for trailering. This person must keep the watercraft in position over the trailer as long as the rear of the watercraft is still afloat. During inclement weather, waves can reek havoc on efforts to minimize unwanted transverse motion.

Next the automobile is started and driven forward, thereby pulling the trailer and watercraft out of the water. As the trailer and watercraft are pulled forward, the rear separation between the watercraft and the trailer, due to the flotation of the watercraft, is diminished and the watercraft eventually becomes completely supported by the trailer. It is critical that the watercraft be held in position over the trailer during this step, especially in the case of watercraft having a hull design other than a V-hull. Examples of such designs include tri-hulls, catamarans, and pontoons. If these watercraft are not maintained in the proper position over the trailer while the watercraft is being pulled from the water, it is possible for the watercraft to fall off the trailer, crashing into the ground and causing great damage to the hull and the trailer.

There is a need for a watercraft lift or trailer which is easy to operate. More specifically, there is a need for a watercraft lift which assists a craft operator in aligning the watercraft with the lift prior to elevating the lift.

There is also a need for a lift which does not present collision hazards, such as stationary upright supports, which can be easily impinged on by the watercraft during normal docking operations.

There is still a further need for a watercraft lift which provides a safe, efficient method of elevating a watercraft, preferably using the power of the watercraft to achieve the desired elevation. Such a lift should obviate the need for pulleys and a manually or motor operated winch and should avoid the various hazards associated therewith.

There is also a need for a lift which elevates a watercraft without requiring a carriage assembly which must be adequately submerged before the watercraft may enter the lift.

There is yet a further need for a watercraft lift which can be safely and easily operated by a single person. This person should be able to safely and effectively operate both the watercraft and the watercraft lift during both a lifting operation and a lowering operation. Preferably, the watercraft lift should be able to be operated from a control position within the watercraft.

There is also a need for a watercraft lift which is easy and safe to use even during inclement weather.

SUMMARY OF THE INVENTION

The present invention solves these needs and pertains generally to a system for elevating a watercraft above the surface of the water using the watercraft's own power to provide the necessary lifting force. As the novel features of the system apply predominantly to the interface between a watercraft and the elevating structure of the present invention, those skilled in the art would readily find the teachings herein advantageously pertinent to both watercraft trailers and watercraft lifts.

In a preferred form, the present invention provides an elevating system having a ramp up which a watercraft can propel itself in order to lift itself out of the water. In one aspect, this ramp is mounted on a plurality of stationary uprights for placement in a body of water, near the shoreline, for use as a watercraft lift.

In another aspect, this novel ramp is used as a trailer and is mounted on at least one pair of wheels and has a trailer hitch at its forward end for attachment to a vehicle.

The preferred ramp system of the present invention has a support mechanism operably attached to the ramp for moveably receiving and supporting the watercraft on the ramp and allowing the watercraft to move forwardly and rearwardly relative to the ramp. This support mechanism is constructed and arranged to allow the propulsion mechanism of the watercraft to maintain operable contact with the water over a predetermined distance while the watercraft is travelling up the ramp. Preferably, in the case of a propeller-driven craft, the propeller is allowed to remain in a down position throughout the elevating process.

In a preferred aspect of the present invention, the support mechanism includes at least one pair of pivotable, axially stationary rails or spars, equipped with a plurality of rollers, constructed and arranged to support a watercraft hull. As a watercraft approaches these spars, contact is made with the rollers, which then direct the watercraft into the center of the mechanism, between the spars, and the watercraft rides these rollers upwardly to achieve an elevated position. The watercraft's propulsion mechanism extends downwardly between the spars, thereby maintaining operable contact with the water.

In other aspects of the present invention, a catch arm is provided to prevent unwanted rearward movement of a watercraft down the ramp. The catch arm is rotatably attached at one end to the ramp assembly and has a limited predetermined range of motion. The catch arm is biased so that when released, the arm swings around its attachment point on the ramp from a released position to an engaged position. At the end of the arm opposite the attachment point, there preferably exists an engagement member operably attached to the arm, which makes positive contact with the watercraft and prevents rearward motion thereby due to gravity or forward acceleration of the ramp by a towing vehicle. In a preferred embodiment, this engagement member is a shaped mass of a durable material providing a low coefficient of friction against a hull, such that the member is able to move against the hull without imparting damage thereto, and in the most preferred form is a wheel rotatably attached to the end of the catch arm.

In still other aspects, the catch mechanism further includes a release arm operably attached to the catch arm for providing leverage for use in causing a downward or forward motion to the catch arm. Operation of the release arm preferably urges the catch arm towards the forward limit of its predetermined range of motion, thereby releasing the watercraft, allowing the craft to slide down the rollers on the rails and enter the body of water into which it is being launched.

It is thus an object of the invention to provide a novel lift or trailer for a watercraft.

It is further an object of the invention to provide a novel lift or trailer for a watercraft which is easy to operate.

It is further an object of the invention to provide a novel lift or trailer for a watercraft which assists the operator in aligning the watercraft with the lift during the lifting operation.

It is also an object of the invention to provide a novel lift or trailer for a watercraft which does not provide any collision hazards against which a watercraft may impinge during a normal docking procedure.

It is further an object of the invention to provide a novel lift or trailer for a watercraft which safely and effortlessly elevates the craft above the surface of the water.

It is another object of the invention to provide a novel lift for a watercraft which elevates the watercraft above the surface of the water without the use of a winch and pulley assembly.

It is yet another object of the invention to provide a novel lift or trailer for a watercraft which utilizes the motive force of the watercraft to elevate the craft above the surface of the water.

It is a further object of the invention to provide a novel lift or trailer for a watercraft which partially or completely obviates the need for a winch.

It is another object of the invention to provide a novel lift or trailer for a watercraft which can be safely and easily operated by a single person.

It is a further object of the invention to provide a novel lift or trailer for a watercraft which can be safely and easily operated by a single person from a control position within the watercraft.

It is also an object of the invention to provide a novel lift or trailer for a watercraft which can be safely and easily operated during inclement weather.

It is finally an object of the invention to provide a novel lift or trailer for a watercraft which avoids the problems associated with prior art watercraft lifts and trailers.

These and further objects and advantages of the present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figures 1, 5:
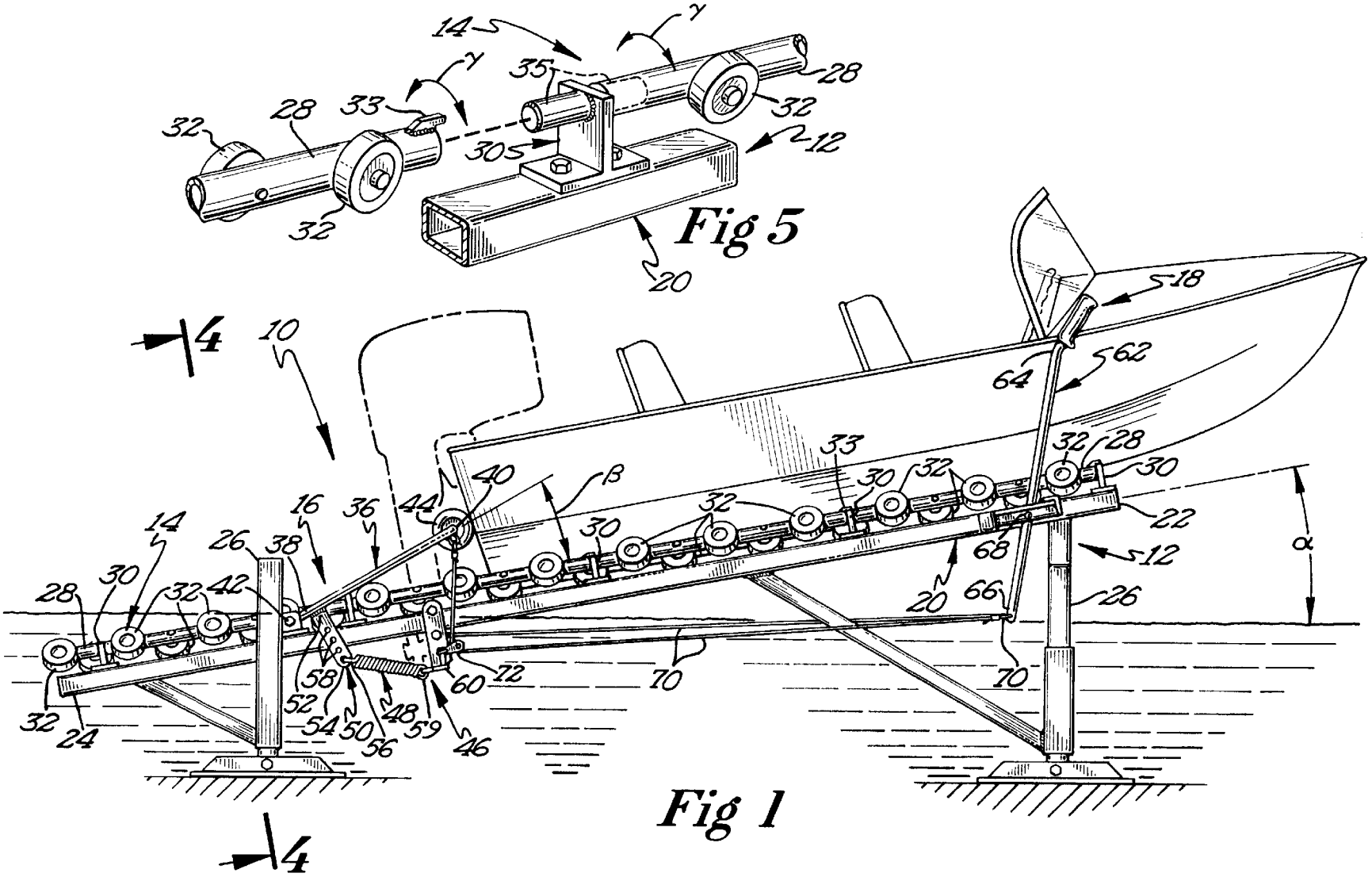
FIG. 1 is a starboard side elevation of a preferred embodiment of the present invention supporting a watercraft which has completely engaged the catch mechanism.
Figures 2, 3:
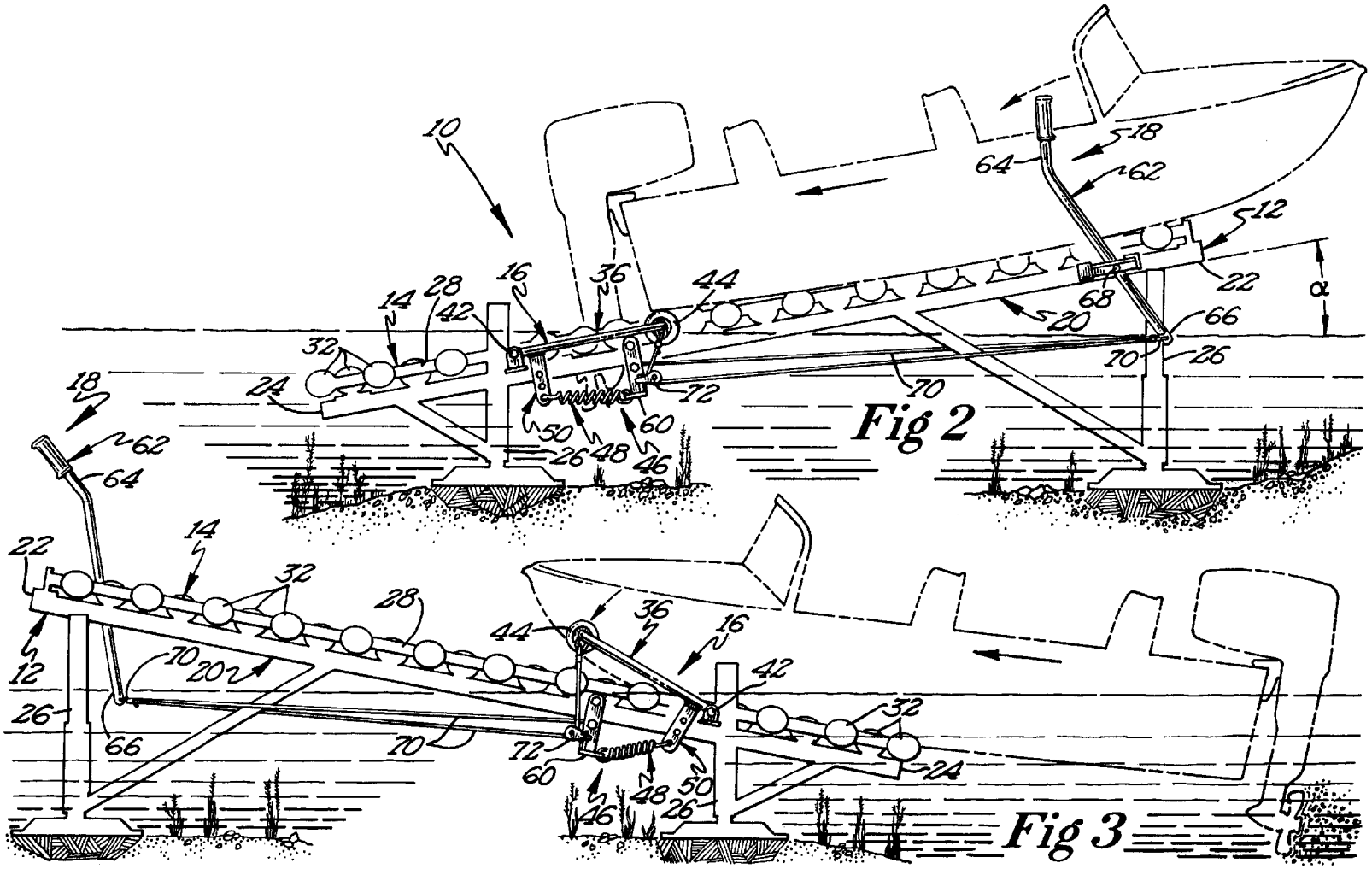
FIG. 2 is a starboard side elevation of a preferred embodiment of the present invention supporting a watercraft which has just been released from the catch mechanism and is descending rearwardly.
FIG. 3 is a port side elevation of a preferred embodiment of the present invention being used by a watercraft which is making an approach and is ascending up the ramp under the watercraft's own power and has made positive contact with the catch mechanism, displacing it downwardly.

All figures are drawn for ease of explanation of the basic teachings of the preferred embodiments only. The extensions of the Figures with respect to number, position, relationship, and dimensions of the parts to form the preferred embodiments will be explained or will be within the skill of the art after the following description has been read and understood. Further, the exact dimensional proportions to conform to the specific force, weight, strength, and similar requirements will likewise be within the skill of the art after the following description has been read and understood.

Where used in the various figures of the drawings, the same numerals designate the same or similar parts. Furthermore, when the terms "top", "bottom", "upper", "lower", "first", "second", "front", "rear", "end", "edge", "forward", "rearward", "upward", "downward", "inside", "side", "longitudinal", "lateral", "horizontal", "vertical", and similar terms are used herein, it should be understood that these terms have reference only to the structure shown in the drawings as it would appear to a person viewing the drawings and are utilized only to facilitate describing the preferred embodiments.

DETAILED DESCRIPTION OF PREFERRED EMBODIMENTS

Referring now to the drawings and first to FIG. 1, there is shown a system or apparatus 10 for elevating a self-propelled, water-borne load, such as a boat or similar watercraft, above the surface of a body of water. System 10 generally comprises a ramp 12, a support mechanism 14 operably attached to ramp 12, a catch mechanism 16, and a release mechanism 18.

Ramp 12 generally provides a frame structure for system 10 and generally includes two beams 20. Ramp 12 has a forward, elevated end 22 and a rearward, subsurface end 24 which is preferably located below the surface of the water when system 10 is in use, with end 22 being elevated above end 24 and above the water surface in the preferred form shown.

Figure 4:
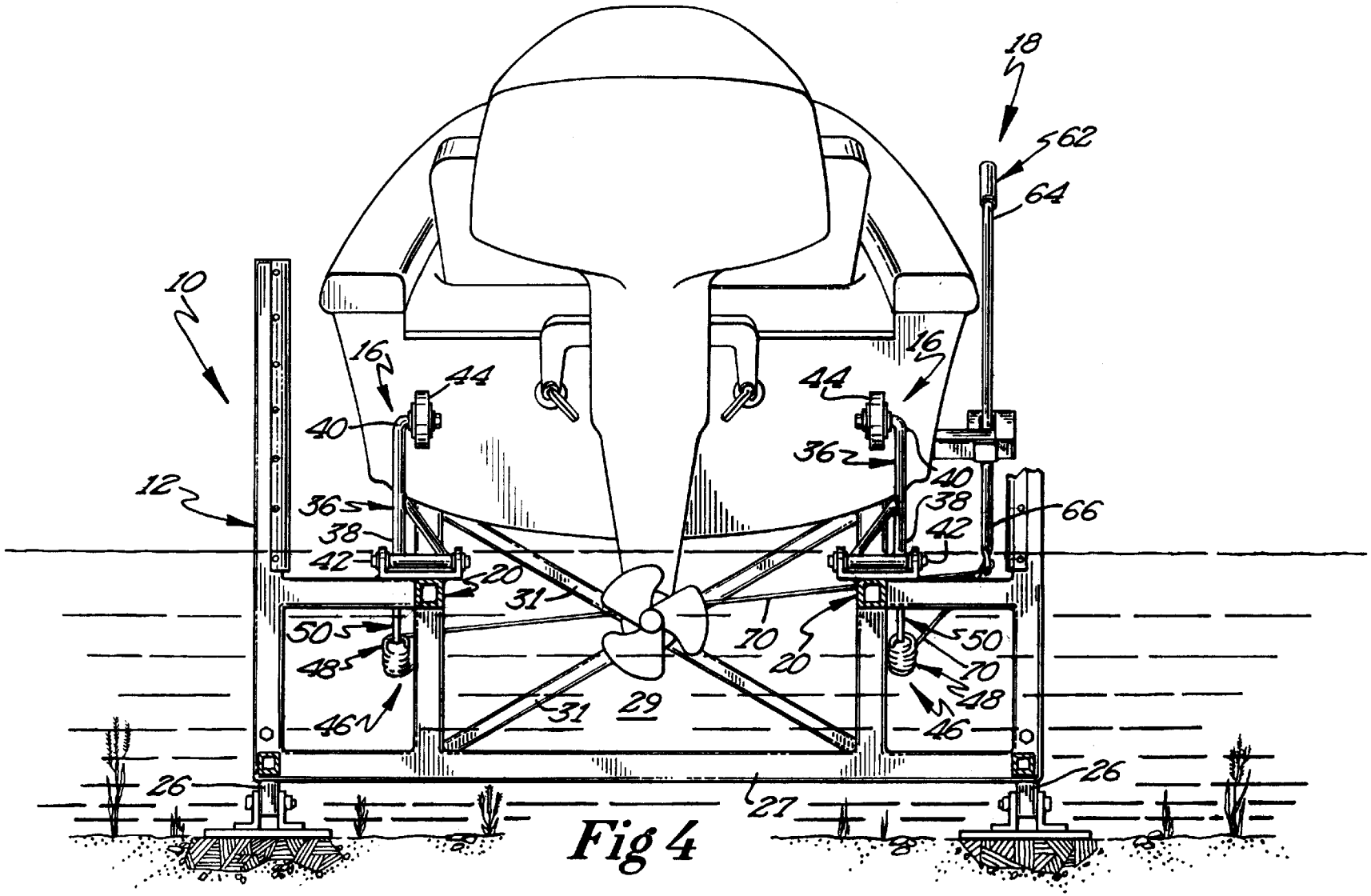
FIG. 4 is a rear elevation of a preferred embodiment of the present invention showing the channel defined by the legs, cross members and spars, for receiving the propulsion mechanism of a watercraft; and, FIG. 5 is a partial, exploded, perspective view of a spar with rollers of a preferred embodiment of the present invention showing the limited angular range of motion of the spar.

It is again noted that system 10 applies to watercraft lifts as well as watercraft trailers. In a preferred embodiment of the present invention, wherein system 10 applies to a watercraft lift, ramp 12 is supported by a plurality of stanchions or legs 26 of adjustable lengths, the lower ends of which contact the bottom of the body of water, thereby adjustably supporting ramp 12 at an appropriate angle $\alpha$ to the surface of the water. Angle $\alpha$ is preferably on the order of 5 to 25 degrees, and more preferably between 10 and 15 degrees. However, due to the adjustability of legs 26, angle $\alpha$ may be selected by the operator to be any acute angle. Legs 26 are spaced apart and held in place by a plurality of cross members 27, shown in FIG. 4, which partially define a channel 29 for receiving the propulsion mechanism of a docking watercraft propelling itself up ramp 12. Further stability can be provided by angled braces 31 which define the forward limits of channel 29 in the form shown. Thus, ramp 12 is constructed and arranged to allow the propulsion mechanism of the watercraft to maintain operable contact with the water over a predetermined distance while traveling up ramp 12.

In an alternative embodiment, wherein system 10 applies to a watercraft trailer (not shown in the Figures), ramp 12 is supported by at least one pair of wheels and has a trailer hitch socket, for placement over the ball of a trailer hitch, proximate its forward end 22. In this embodiment, it is preferable that ramp 10 remain relatively parallel to the surface on which it rests. In other words, angle $\alpha$, which provides the necessary elevation relative to the water, is provided by the angled surface of the watercraft ramp being used to launch or recover the watercraft. Alternately, ramp 10 may be angled upwardly to ensure a watercraft carried thereon maintains positive, supporting contact with catch mechanism 16, discussed in more detail below.

Ramp 12 carries support mechanism 14 which moveably receives and supports the watercraft on ramp 12 and which allows the watercraft to move forwardly and rearwardly relative to ramp 12. Preferably, support mechanism 14 includes at least one pair of support spars 28, preferably having a circular cross section, attached to beams 20 using a plurality of mounting brackets 30, as best seen in FIG. 5. Preferably, spars 28 provide a mounting surface for a plurality of support rollers 32. Rollers 32 function to support the watercraft and allow it to slide or roll in a forward and rearward direction along the length of ramp 12. Rollers 32 are operably and rotatably attached to spars 28 so that their axes of rotation are substantially perpendicular to the central axes of spars 28. Support rollers 32 are spaced apart along the length of spars 28 at predetermined intervals such that adequate support is provided for a given watercraft throughout the length of travel during a docking or undocking procedure. Preferably, support rollers 32 are spaced apart on alternating sides of spars 28, thereby providing a static balance of the forces around the central axes of spars 28. Rollers 32 must be close enough to prevent contact between the hull of a watercraft and spars 28 when the angle between a substantially afloat craft and ramp 12 approaches the complementary angle of $\alpha$, $(180°-\alpha)$. Rollers 32 on either side of a given spar 28 are depicted in the Figures as being substantially parallel with those rollers on the opposite side of the spar 28. However, it is envisioned that rollers 32 on one side of a spar 28 may present an interior angle of less than 180° with the rollers 32 on the other side of the spar 28.

In the preferred embodiment of FIG. 5, to facilitate spar rotation, mounting brackets 30 include male extensions 35 insertable within spars 28 and providing rotatable support thereto. In the preferred form, it is envisioned that spars 28 have a limited angular range of motion $\gamma$ around their central axes. Preferably this range of motion, between 20° and 80°, more preferably on the order of 45°, allows the spars 28 to be influenced when acted upon by the hull of a watercraft, such that rollers 32 or any other contact devices attached to the spars 28 for contact with the hull may find an optimal orientation to conform to the shape of the hull. This range of motion may be defined by providing a spar stop 33 which is integral with the top of a section of spar 28 and extends over mounting bracket 30 such that angular movement-limiting contact is made between spar stop 33 and mounting bracket 30. The angular mobility of spars 28 will cause rollers 32 to assume a normal or perpendicular orientation to the hull of a docking watercraft. Assuming a normal orientation minimizes undesirable stresses placed on the bearings of rollers 32.

In an alternative embodiment, not shown in the Figures, support mechanism 14 includes rollers mounted directly on the ramp beams by a plurality of mounting brackets. This embodiment requires more mounting brackets than the embodiment using spars described above. Preferably, these mounting brackets would allow the axes of rotation of the rollers a limited range of angular motion around an axis loosely defined by the ramp, preferably between 20 and 60 degrees, more preferably on the order of 45 degrees, so that each roller may assume an orientation wherein the axis of rotation of the roller is substantially parallel to the hull of the watercraft where the roller is making contact.

In another alternative embodiment, not shown in the Figures, support mechanism 14 is in the form of a carriage assembly slideably attached to ramp 12, wherein the carriage assembly acts as a liaison between the hull of the craft and the rollers, which may be disposed on the ramp or on the carriage assembly. The carriage assembly preferably comprises port and starboard longitudinal members and cross members connecting said longitudinal members and providing structural support thereto. The cross members are shaped and arranged to accept and support the hull of the watercraft. Rails are operably attached to the ramp and define slots sized to receive wheels operably attached to the longitudinal members allowing directionally controlled relative motion between the carriage assembly and the ramp such that the carriage assembly may ride up and down the rails in forward and rearward directions. Conversely, the ramp may carry wheeled members aligned with inverted rails operably attached to the longitudinal members of the carriage assembly. As a watercraft approaches the ramp of this embodiment, it makes contact with a carriage assembly, and rides the carriage assembly up the ramp. Furthermore, the carriage assembly is oriented parallel to the ramp system and, therefore, is angled relative to the surface of the water. This angling ensures a steady egress of air from within the tubular structure of the assembly, thereby preventing the possibility of flotation or an undue delay in submergence when the empty assembly contacts the water.

A watercraft using system 10 according to the teachings of the present invention is held thereon by a catch mechanism 16. Preferably, catch mechanism 16 generally includes a catch arm 36, pivotal between an engaged and released position, having a first end 38 and a second end 40. Catch mechanism 16 is preferably biased toward the engaged position.

Catch arm first end 38 is rotatably attached to ramp 12 at a catch arm pivot point 42. Catch arm second end 40 carries an engagement member 44, operably attached thereto, for making contact to the hull of the watercraft. Engagement member 44 is constructed and arranged to be traveled over by the watercraft as it is docking and undocking without damaging the hull. It is, therefore, preferable that engagement member 44 be designed to ensure that a low coefficient of friction exist between the engagement member 44 and a boat hull. Preferably, engagement member 44 comprises a wheel rotatably attached to catch arm second end 40. The axis of rotation of engagement member 44 is preferably substantially parallel to the axis of rotation of catch arm 36 around pivot point 42.

A biasing mechanism 46 is operably attached to catch arm 36 and causes catch arm 36 to rotate around pivot point 42 from the released position to the engaged position when engagement member 44 is not acted on by a watercraft or other external force. It should be understood that catch arm 36 rotates around pivot point 42 in a necessarily circular motion having vertical and horizontal components. It is further understood that for a given circular direction over a given angular range, the magnitude of the vertical component, as compared to the horizontal component, varies with the starting and finishing angles. One skilled in the art would readily understand that catch mechanism 16 may be constructed and arranged to operate in a substantially vertical direction of movement, such as would be the case with a relatively long catch arm 36 and relatively small ramp angle $\alpha$. Conversely, mechanism 16 may be constructed and arranged to operate in a substantially horizontal direction, such as would be the case with a relatively short catch arm 36 and/or a relatively large ramp angle $\alpha$.

Regardless of the ramp angle $\alpha$, it is important that catch arm 36, having achieved an engaged position, does not present an overly large angle $\beta$ to that of the ramp. In other words, if catch arm 36 approaches a perpendicular relationship with ramp 12, the forces placed on engagement member 44 by the watercraft will result in undue stress felt by catch arm 36 proximate catch pivot point 42. Additionally, too much force will be required to move catch arm 36 to a disengaged position by pulling on release arm 62. If catch arm 36 approaches a perpendicular relationship with ramp 12, in other words if $\beta$ approaches 90°, moving catch arm 36 to a disengaged position, which is necessarily substantially parallel to ramp 12, will include angular movement by catch arm 36 having a component in the direction of ramp 12 which is significant and which will equal required movement up ramp 12 by the watercraft. An engagement angle $\beta$ can thus be defined between catch arm 36 and ramp 12 which preferably does not exceed 35°.

Biasing mechanism 46 preferably includes a spring 48 operably attached at one end 59 to a fixed portion of system 10 such as beam 20. More preferably, biasing mechanism 46 further includes an appendage 50 extending downwardly from catch arm 36 proximate catch arm first end 38, forward of pivot point 42. In this embodiment, appendage 50 has an upper, proximal portion 52 which is attached to or integral with catch arm 36, and a distal portion 54 opposite proximal portion 52. Spring 48 has a rearward end 56 attached to distal portion 54. In a preferred embodiment, distal portion 54 defines a plurality of spaced apart holes or attachment provisions 58 for providing a variety of places to attach spring end 56 to appendage 50, each of which imparting a different degree of tension to spring 48 when used. Spring 48 preferably is closed biased so that catch arm appendage distal portion 54 is continually urged toward ramp appendage 60, thereby rotating catch arm 36 in an upward or rearward engaging direction to the engaged position.

Once engagement member 44 is no longer held in a disengaged position by a load, spring 48 will urge catch arm 36 toward an engaged position. Catch arm 36 will rotate toward the engaged position until spring 48 is completely closed and has released all of its energy stored therein. Additionally, a stop (not shown in the figures) could be employed to prevent catch arm 36 from rotating past a desired point. This stop could be operably attached to the catch arm first end 38, to the catch arm 42, or to release arm 62 which necessarily moves with catch arm 36 provided that tension is maintained in the release cables 70.

In order to disengage catch mechanism 16, release mechanism 18 is provided. For the preferred form shown, release mechanism 18 generally includes a release arm 62 having an upper end 64 and a lower end 66 and is pivotally attached to ramp 12 at a pivot point 68 located between upper end 64 and lower end 66. Upper end 64 is above pivot point 68 and arranged to be graspable from a position on the watercraft docked in system 10. Release arm 62 is operably connected to catch mechanism 16 via a release cable 70 extending from release arm lower end 66 to catch arm second end 40. Preferably, in order to convert the substantially horizontal pull imparted on cable 70 when release arm upper end 64 is pulled rearwardly, to the necessary substantially downward movement needed to pull engagement member 44 below the hull of a watercraft, cable 70 passes through a pulley 72 which is operably attached to ramp appendage 60.

In a preferred embodiment, system 10 includes a starboard catch mechanism 16 and a substantially identical port catch mechanism 16, as shown in the drawings. This arrangement provides that the stem of the watercraft is contacted by an engagement member 44 on either side of its propulsion-mechanism. To facilitate two catch mechanisms 16, each component thereof is provided on either side of system 10. Both catch arms 36 have a release cable 70 extending therefrom. However, it is preferred that both catch mechanisms 16 be releasable by a single release mechanism 18. To effect this, release cables 70 both extend forwardly at converging angles and are attached to common release arm lower end 66.

In operation, system 10 operates in the following manner during a docking procedure:

A watercraft such as a boat as shown makes an approach on system 10 by lining up the centerline of the watercraft between beams 20 of ramp 12. A portion of ramp 12 will necessarily protrude above the surface of the water to provide a visual "target" to navigate toward. At some point during the approach, the bow of the watercraft will make contact with one or more roller 32 and the watercraft will be urged toward the centerline of system 10. This centering force is due to the V shape common to most hulls and will be more pronounced on watercraft with sharper hulls. Though the present invention also functions effectively with watercraft have alternatively shaped hulls, such as flat bottomed watercraft and the like, more care must be taken to ensure the watercraft is properly aligned with the ramp 12.

Once the watercraft is centered, spars 28 will rotate around male extension 35, from a position of rest wherein spar stops 33 acted against mounting brackets 30, to a supporting position wherein rollers 32 achieve an optimal, likely perpendicular, angular relationship with the hull of the watercraft. As the watercraft continues its approach, the hull will make contact with increasing numbers of rollers 32 and the weight of the watercraft will be transferred from the water to support rollers 32. Simultaneously, the watercraft will ascend up ramp 12 and eventually assume angle $\alpha$.

As the watercraft makes its ascent, the hull contacts and downwardly displaces engagement members 44, thereby rotating catch arms 36 in forward, downward directions around pivot points 42 from their engaged positions to their released positions. This also rotates catch arm appendages 50 in downward, rearward directions, thereby increasing the distances between catch arm appendage distal portions 54 and ramp appendages 60, and stretching springs 48, storing energy therein. Eventually, the hull completely passes over engagement members 44 so that they are no longer being held in downward or forward positions by the hull. Energy stored in springs 48 is released, thereby pulling catch arm appendages 50 toward ramp appendages 60 rotating catch arms 36 around pivot points 42 to their upper, rearward extents to their engaged positions. Engagement members 44 follow the stern of the hull, stopping the rearward descent of the watercraft down ramp 12 once the watercraft has achieved the predetermined elevation.

The watercraft's propulsion mechanism remains in operative contact with the water during substantially the entire docking process and provides the motive force to propel the watercraft up ramp 12 until the hull has completely passed over engagement member 44 and has achieved a docked position whereby the hull is substantially out of the water. Any forward movement of the watercraft is then stopped, either by shutting off or otherwise disabling the propulsion mechanism, or because the propulsion mechanism has lost operable contact with the water.

In order to release the watercraft during an undocking procedure, release arm upper end 64 is pulled rearwardly, preferably from a position inside the watercraft, pivoting release arm 62 around pivot point 68 thereby causing release arm lower end 66 to move in a forward direction. Release arm 62 thereby pulls release cables 70 forward through pulleys 72, urging catch arms 36 toward their released position and pulling engagement members 44 downward and forward until they are no longer in contact with the stern of the hull and releasing the watercraft. Thus, the watercraft is allowed to descend down ramp 12 due to angle a along rollers 32 into the water.

Those skilled in the art will further appreciate that the present invention may be embodied in other specific forms without departing from the spirit or central attributes thereof. In that the foregoing description of the present invention discloses only exemplary embodiments thereof, it is to be understood that other variations are contemplated as being within the scope of the present invention.

For example, it is envisioned that a plurality of catch arms could be provided at predetermined positions along the length of the ramp. Multiple catch arms would allow for a longer ramp which could remain in one place in the body of water and be effective regardless of changing water levels. For example, when a lake is low, a watercraft engaging an embodiment of the present invention would make contact with the ramp at a position closer to its lower end than would a watercraft engaging the present invention at a time when the same lake is high. A plurality of catch mechanisms would allow the same watercraft to achieve substantially the same elevation above the water throughout a range of potential water levels.

Accordingly, the present invention is not limited in the particular embodiments which have been described in detail therein. Rather, reference should be made to the appended claims as indicative of the scope and content of the present invention.

What is claimed is:

1. An apparatus for maintaining a watercraft, at a predetermined elevation over a body of water on a forwardly elevated ramp having a support surface, the watercraft moveably engaging on the ramp support surface, the apparatus comprising:

a displaceable catch arm having a first end and a second end, said first end rotatably attached to the ramp at a catch arm pivot point at or below the ramp support surface, said second end opposite said first end;

a biasing mechanism operably attached to said catch arm, biasing said catch arm toward an engaged position above said ramp support surface;

an engagement member operably disposed on said catch arm second end and making operable contact with the watercraft in such a manner that said member may be moved across a surface of the watercraft without causing damage thereto; and, a release mechanism operably attached to said catch arm such that when said release mechanism is operated, said catch arm is displaced toward a released position at or below the ramp support surface, thereby releasing the watercraft.

2. The apparatus of claim 1 wherein said biasing mechanism comprises:

a spring operably attached to the ramp at one end and to said catch arm at another end;

wherein said spring biases said catch arm toward said engaged position.

3. The apparatus of claim 1 wherein said engagement member comprises a wheel rotatably attached to said catch arm second end.

4. The apparatus of claim 1 wherein said engagement member comprises a shaped mass of a durable material having a low coefficient of friction against the watercraft.

5. The apparatus of claim 1 wherein said biasing mechanism comprises:

a spring operably attached at a rearward end to said ramp; and a catch arm appendage operably attached at a proximal portion to said catch arm, proximate and forward of said catch arm first end, extending downwardly therefrom, and operably attached at a distal portion to a rearward end of said spring; wherein said spring is closed biased such that when said catch arm second end is not subject to either a forward or a downward force, said spring contracts thereby pulling said catch arm appendage distal portion toward said spring forward end, thereby causing said catch arm to rotate about said catch arm pivot point in an engaging direction.

6. An apparatus for maintaining a watercraft, at a predetermined elevation over a body of water on a forwardly elevated ramp, the watercraft moveably engaging the ramp, the apparatus comprising:

a displaceable catch arm having a first end and a second end, said first end rotatably attached to the ramp at a catch arm pivot point, said second end opposite said first end;

a biasing mechanism operably attached to said catch arm, biasing said catch arm toward an engaged position;

an engagement member operably disposed on said catch arm second end and making operable contact with the watercraft in such a manner that said member may be moved across a surface of the watercraft without causing damage thereto;

a release mechanism operably attached to said catch arm such that when said release mechanism is operated, said catch arm is displaced toward a released position, thereby releasing the watercraft;

a release arm pivotally attached to said ramp at a pivot point, said release arm having an upper end and a lower end, said upper end being above said pivot point and arranged to be graspable from a position on the watercraft, said release arm operably connected to said catch arm; and, said release mechanism constructed and arranged so that when said release arm is pivoted around said pivot point, said release arm urges said catch arm toward said released position, thereby releasing the watercraft.

7. The apparatus of claim 6 wherein said release mechanism further comprises:

a ramp appendage fixed to said ramp and including a pulley operably attached to said appendage; and, a release cable extending from said release arm, through said pulley, to said catch arm second end.

8. A system useable in a body of water with a bottom and a surface comprising:

a ramp having a rearward, subsurface end and a forward end elevated above the rearward end;

a support mechanism, operably attached to said ramp, moveably receiving and supporting the watercraft on said ramp and allowing the watercraft to move forwardly and rearwardly relative to said ramp, said support mechanism and said ramp constructed and arranged to allow the propulsion mechanism of the watercraft to maintain operable contact with the water over a predetermined distance while travelling up said ramp;

a catch mechanism useable to prevent rearward motion by the watercraft once the watercraft has achieved a predetermined elevation, said catch mechanism comprising:

a displaceable catch arm, moveable between an engaged position and a released position, having a first end and a second end, said first end rotatably attached to said ramp at a catch arm pivot point, said second end opposite said first end;

a biasing mechanism operably attached to said catch arm, urging said catch arm toward said engaged position; and, an engagement member operably disposed on said catch arm second end, able to make operable contact with the watercraft in such a manner that said member may be moved across a surface of the watercraft without causing damage thereto; and, a release mechanism operably attached to said catch arm such that when said release mechanism is operated, said catch arm is displaced toward said released position, thereby releasing the watercraft.

9. The system of claim 8 wherein said biasing mechanism comprises:

a spring operably attached to said ramp and to said catch arm and biased such that said spring urges said catch arm to rotate about said catch arm pivot point toward said engaged position.

10. The system of claim 8 wherein said support mechanism comprises:

at least one pair of spars;

a plurality of mounting brackets attaching said spars to said ramp; and, a plurality of support rollers rotatably positioned at predetermined intervals along said spars.

11. The system of claim 10 wherein said mounting brackets are constructed and arranged to rotatably attach said spars to said ramp such that when said support rollers are supporting the hull of the watercraft, the spars rotate to adjustably receive the watercraft.

12. The system of claim 10 wherein said support rollers are constructed and arranged for making contact with a hull of the watercraft.

13. The system of claim 8 wherein said engagement member comprises a shaped mass of a durable material having a low coefficient of friction against the hull of the watercraft, such that said member is able to move against the hull without imparting damage thereto.

14. The system of claim 13 wherein said engagement member further comprises a wheel rotatably attached to said catch arm second end.

15. The system of claim 8 wherein said release mechanism comprises:

a release arm pivotally attached to said ramp at a pivot point, said arm having an upper end and a lower end, said upper end being above said pivot point and arranged to be graspable from a position on the watercraft, said release arm operably attached to said catch arm;

said release mechanism constructed and arranged so that when said release arm upper end is grasped and pulled, said release arm pivots around said pivot point, thereby moving said catch arm toward said released position.

16. The system of claim 15 further comprising:

a ramp appendage fixed to said ramp and including a pulley operably attached to said appendage; and, a release cable extending from said release arm, through said pulley, to said catch arm second end.

17. The system of claim 8 further comprising:

a plurality of legs of adjustable lengths having upper and lower ends, said legs supportably attached to said ramp, said lower ends constructed and arranged to contact the bottom of the body of water, thereby adjustably supporting said ramp at an appropriate angle to the surface of the water; and, a plurality of spaced apart cross members operably attached to said legs for holding said legs in place relative to said ramp.

18. The system of claim 17 further comprising an elongate channel for receiving the propulsion mechanism of the watercraft, the channel defined by said ramp, said legs, and said cross members.

19. The system of claim 8 wherein said ramp further comprises two spaced apart beams and said catch mechanism is operably attached to one of said beams.

20. The system of claim 19 further comprising a second catch mechanism, substantially similar to said first catch mechanism and operably attached to the other of said beams.

* * * * *